US007922499B2

(12) United States Patent
Liao

(10) Patent No.: US 7,922,499 B2
(45) Date of Patent: Apr. 12, 2011

(54) ELECTRICAL TERMINAL

(75) Inventor: Chi-Nan Liao, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/471,499

(22) Filed: May 26, 2009

(65) Prior Publication Data

US 2009/0291574 A1 Nov. 26, 2009

(30) Foreign Application Priority Data

May 26, 2008 (CN) ..... 09 7 209118

(51) Int. Cl.
*H01R 12/00* (2006.01)

(52) U.S. Cl. ..... 439/74; 439/660; 439/83

(58) Field of Classification Search ..... 439/660, 439/74, 83

See application file for complete search history.

(56) References Cited

U.S. PATENT DOCUMENTS

| | | | | |
|---|---|---|---|---|
| 5,975,916 | A | 11/1999 | Okura | |
| 7,320,605 | B2 * | 1/2008 | Chang et al. | 439/74 |
| 7,320,606 | B2 * | 1/2008 | Midorikawa | 439/74 |
| 7,344,387 | B2 * | 3/2008 | Shiroyama | 439/74 |
| 7,410,364 | B2 * | 8/2008 | Kishi et al. | 439/74 |
| 2003/0134530 | A1 * | 7/2003 | Yu-Feng | 439/83 |
| 2006/0216970 | A1 * | 9/2006 | Pavlovic | 439/83 |

* cited by examiner

*Primary Examiner* — Hien Vu

(74) *Attorney, Agent, or Firm* — Andrew C. Cheng; Wei Te Chung; Ming Chieh Chang

(57) ABSTRACT

An electrical terminal (20) used with board-mounted connector (2) having a housing comprising (21): a fixing portion, a contacting portion (204) and a soldering portion (202). The fixing portion defines barbs formed along opposite edges thereof for securing the terminal within the housing, the contacting portion (204) extends from on side of the fixing portion and the soldering portion extends away from the other side of the fixing portion. The soldering portion (202) extends obliquely towards a circuit board on which the connector (2) is mounted, the soldering portion having a tip end with a reduced thickness thereof.

5 Claims, 5 Drawing Sheets

ELECTRICAL TERMINAL

BACKGROUND OF THE INVENTION

1. Field of the Invention

The present invention relates to an electrical terminal, and in particular to an electrical terminal used in a board-mounted connector.

2. Description of Prior Arts

Traditionally, electrical terminals are arranged in an insulative housing to form a connector. The terminal defines a soldering portion. The soldering portion extends externally from the insulative housing for soldering to a print circuit board (PCB) of another electrical apparatus. Usually, the soldering portion is designed parallel to the PCB. While, in application, due to manufacturing tolerance, the soldering portion will extend obliquely toward or away from the PCB. When a plurality of soldering portions extend obliquely away from the PCB, the plurality of soldering portions can not be aligned in a plane parallel to the PCB. this situation will influence the outlook of the connector. In order to resolve such problem, the soldering portion are designed to extend obliquely towards the PCB. However, the drawback still occurs for the reason of the form tolerance.

Therefore, it is desirable to provide an electrical terminal that eliminates the aforesaid problems.

SUMMARY OF THE INVENTION

Accordingly, an object of the present invention is to provide an electrical terminal which reduces the height tolerance of the electrical terminal.

In the exemplary embodiment of the invention, an electrical terminal used with board-mounted connector having a housing comprises: a fixing portion with barbs formed along opposite edges thereof for securing the terminal within said housing, a contacting portion extending from one side of the fixing portion, and a soldering portion extending away from the other side of the fixing portion, and obliquely towards a circuit board on which the connector is mounted. The soldering portion has a tip end with a reduced thickness thereof.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
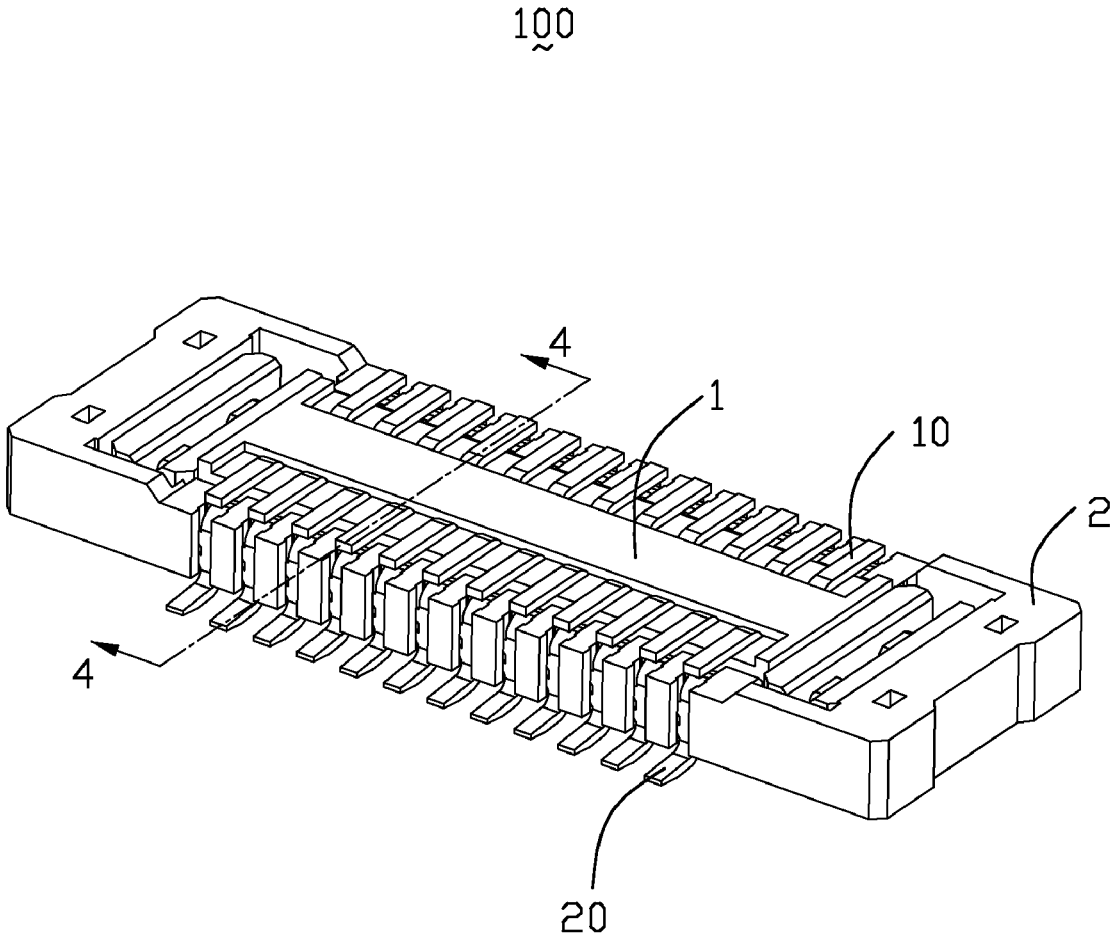
FIG. 1 is a perspective view of a plug connector mating with a receptacle connector in accordance with the present invention.
Figure 2:
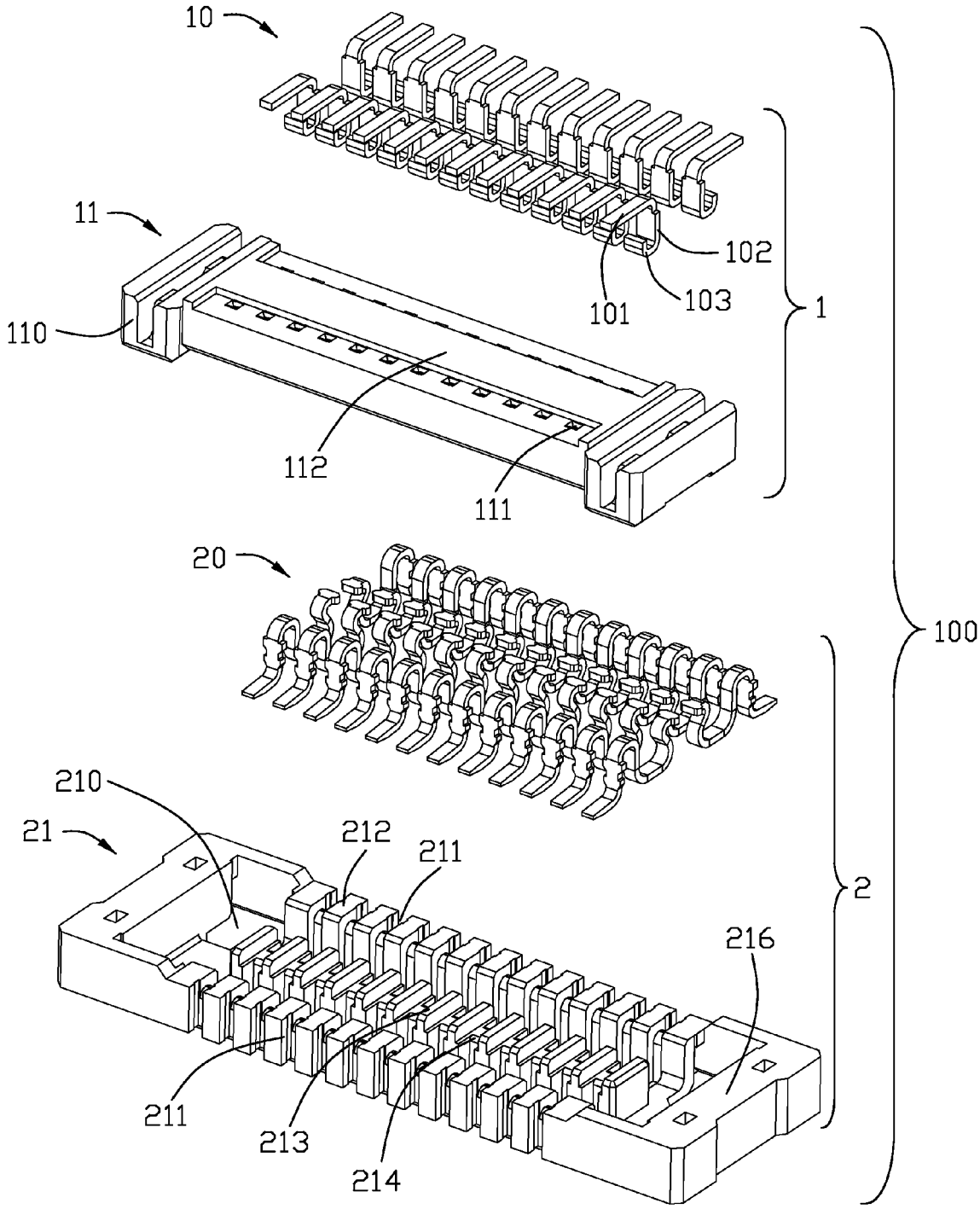
FIG. 2 is an exploded view of the plug connector and the receptacle connector.

Referring to FIGS. 1 and 2, the present invention relates to a plurality of electrical terminals 20 received in a first insulative housing 21. The plurality of electrical terminals 20 and the first insulative housing 21 constitute to a receptacle connector 2. The receptacle connector 2 is used to receive a plug connector 1. The plug connector 1 comprises a second insulative housing 11 and a plurality of contacts 10 received in the second insulative housing 11.

Referring to FIG. 2, the first insulative housing 21 includes a pair of longitudinal walls 212, a pair of transverse walls 216, a receiving cavity 210 surrounded by the pair of longitudinal walls 212 and transverse walls 216, and a tongue board 213 extending from a bottom wall (not labeled). The pair of longitudinal walls 212 define a plurality of first passageways 211, and the tongue board 213 has a plurality of second channels 214 according to the first passageways 211.

Figure 3:
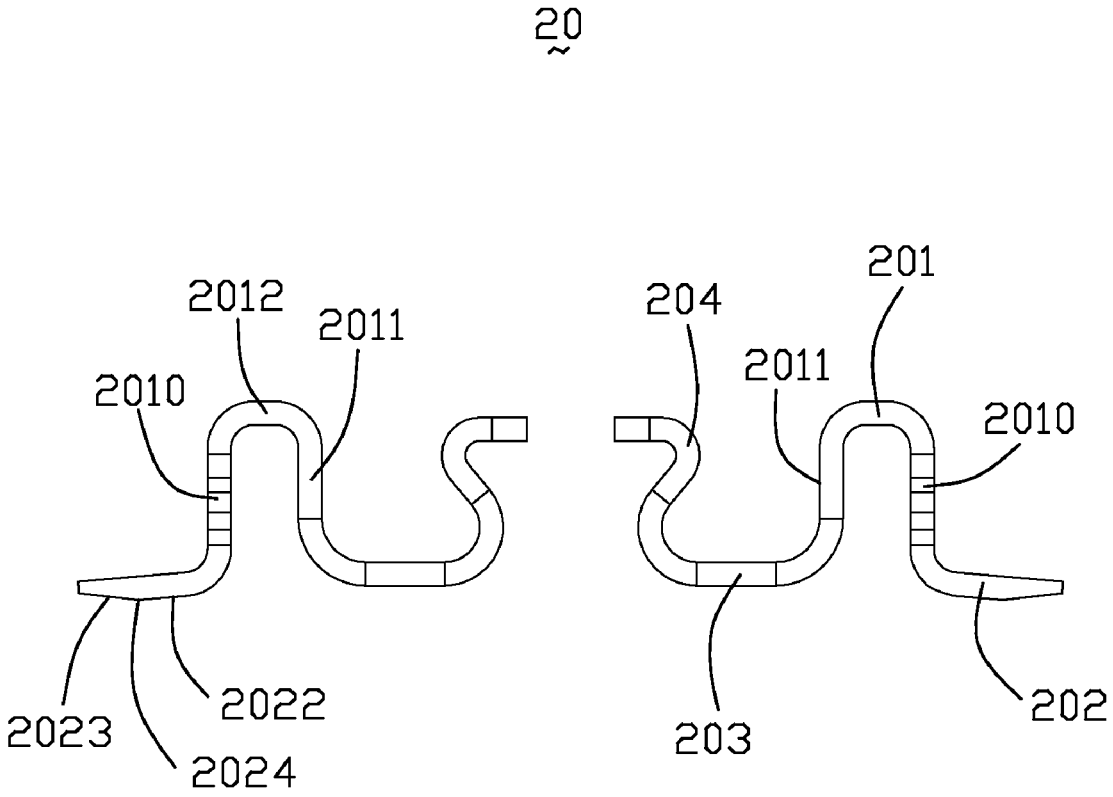
FIG. 3 is a front elevational view of a pair of electrical terminals of the present invention.
Figure 5:
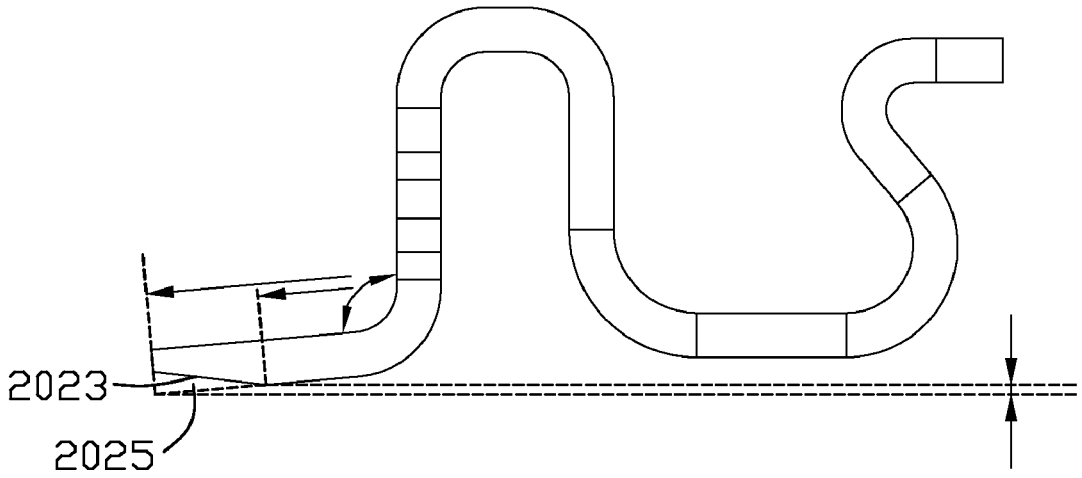
FIG. 5 is a front elevational view of the electrical terminal of the present invention.

Referring to FIGS. 3 and 5, the electrical terminal 20 comprises a fixing portion 201, an extending portion 203 extending from the fixing portion 201, a flexible contacting portion 204 extending from the extending portion 203 and a soldering portion 202 extending from the other end of the extending portion 203. The fixing portion 201 has a first vertical arm 2010, a second vertical arm 2011 and a connecting arm 2012 connects the first vertical arm 2010 and the second vertical arm 2011. A distance of a cutout defined between the flexible contacting portion 204 and vertical arm 2011 is smaller than a length of the extending portion 203. The soldering portion 202 is disposed on a horizontal plane (not shown), the lower surface 2022 of the soldering portion 202 engages with the horizontal plane. The angle between the soldering portion 202 and the first vertical arm 2010 is retained more than 90 degree.

Referring to FIG. 3, the lower surface 2022 of the solder portion 202 comprises a lower surface 2022, an inclined surface 2023 and a transition line 2024 between the lower surface 2022 and inclined surface 2023. A space 2025 is defined below a tip end of the soldering portion 202 and adjacent to the lower surface 2022. That is, in this preferred embodiment, the tip end of the soldering portion 202 has a reduced thickness compared to the rest of the contact.

Referring to FIGS. 3 and 5, the soldering portion 202 has a deflected bottom surface. The inclined surface 2023 forms an outer segment which obliquely outwardly upwardly extends from the transition line 2024. The lower surface 2022 forms an inner segment which obliquely inwardly upwardly extends from the transition line 2024. The transition line 2024 is located between the out and inner segments for being seated upon a printed circuit board (not shown). The soldering portion 202 essentially outwardly obliquely downwardly extends relative to the first insulative housing 21. The soldering portion 202 defines a flat upper surface extending parallel to the inner segment.

Referring to FIG. 5, the transition line 2024 is the lowest point of the lower surface 2022 of the soldering portion 202 because of the space 2025. The angle tolerance between the lower surface 2022 and the horizontal plane can influence the height of the electrical terminal 20. The transition line 2024 is in place of the free end to reduce the influence of the angle tolerance. That is, the height tolerance of the electrical terminal 20 is reduced. In fact, the distance between the transition line 2024 and the free end more larger, the efficiency of reducing height tolerance is more obvious.

Figure 4:
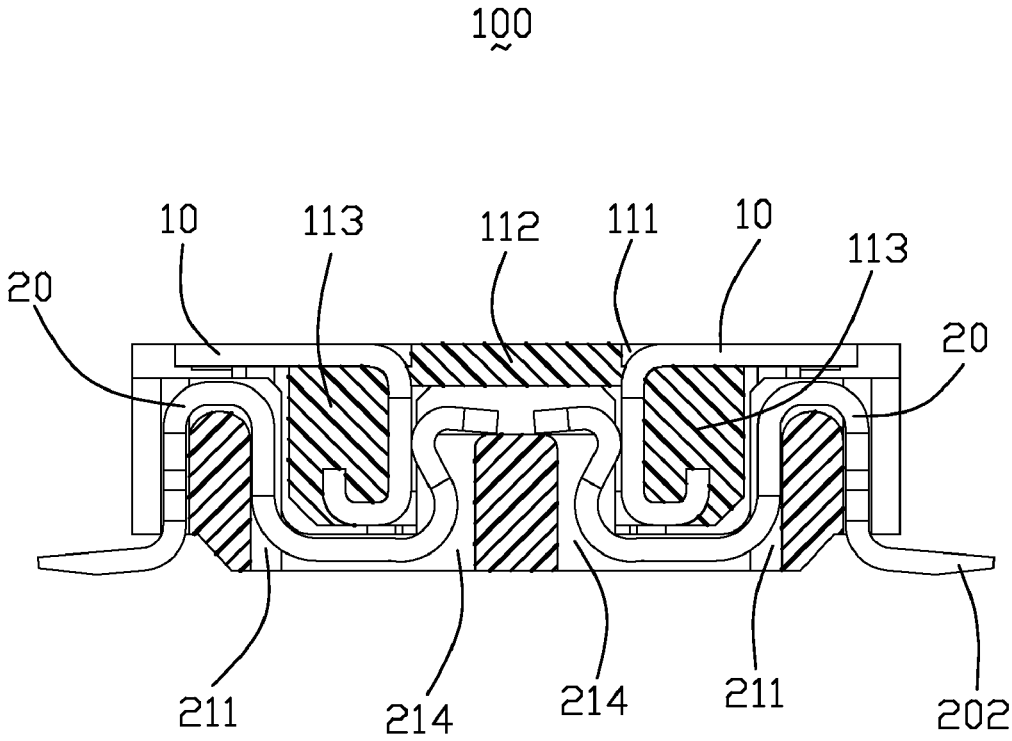
FIG. 4 is a cross-section view along the line 4-4 according to the FIG. 1.

Referring to FIGS. 2 and 4, The second insulative housing 11 defines two rows of slots 111 to contain the contacts 10. These slots 111 are divided by a plurality of protrusions 113. The bottom surface of the second insulative housing 11 has a rib 112. Two opposite sides of the rib 112 include a mating portion 110, respectively. The pair of mating portions 110 are inserted into the receiving cavity 210 of the first insulative housing 21. The contacts 10 comprises a soldering portion 101, a contacting portion 102 and a fixing portion 103. The soldering portion 101 extends externally from the bottom surface of the second insulative housing 11. The fixing portion 103 is fixed in the slots 111. The contacting portion 102 engages with the flexible contacting portion 204 of the first terminal 20 to constitute electrically connect.

In the embodiment of the present invention, the space 2025 is disposed between the inclined surface 2023 and the horizontal plane or a top face of the PCB. The space 2025 provides rooms for the free end of the soldering portion 202 from engaging with the horizontal plane, and leads the transition line 2024 engaging with the horizontal plane. Thus, the effect of the angle tolerance will be reduced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A board-mounted electrical connector mounted on a circuit board, comprising:

a housing;

a plurality of terminals received in said housing, the terminal having a fixing portion, a contacting portion and a soldering portion, the contacting portion and the soldering portion extending from opposite sides of the fixing portion, respectively; and the soldering portion extending obliquely toward said circuit board and comprising an upper surface, a lower surface disposed on said circuit board and a free end, an angle between the upper surface and the fixing portion being more than 90 degree;

wherein a space is defined below the free end and adjacent to the lower surface;

wherein the housing comprises a pair of longitudinal walls, a pair of transverse walls and a longitudinal bottom wall extended between the pair of longitudinal walls and the transverse walls, a receiving cavity surrounded by said pair of longitudinal and transverse walls, and a tongue board extending from the bottom wall of said receiving cavity;

wherein the pairs of longitudinal walls and the tongue define a plurality of passageways, respectively, and wherein the passageways extend along a direction perpendicular to the longitudinal wall;

wherein end portions of the contact portions resting against a top surface of the bottom wall.

2. The board-mounted electrical connector as claimed in claim 1, wherein the soldering portion extends externally from the housing, the fixing portion is retained in the passageway and the contacting portion extends into the cavity to engage with a mating terminal of a mating connector.

3. A board-mounted electrical connector mounted on a circuit board, comprising:

an insulative housing;

a plurality of terminals received in said housing, the terminals each having a fixing portion, a contacting portion and a soldering portion, the contacting portion and the soldering portion extending from the fixing portion oppositely, respectively; and the soldering portion extending with a deflected bottom surface thereof to form a transition line between an outer segment which obliquely outwardly upwardly extends from the transition line, and an inner segment which obliquely inwardly upwardly extends from the transition line;

wherein said transition line is for use with being seated upon a printed circuit board;

wherein a thickness of the soldering portion on the outer segment is smaller than that on the inner segment;

wherein the thickness of the solder in portion on the outer segment is gradually reduced away from said transition line while that on the inner segment is constant;

wherein the housing comprises a pair of longitudinal walls, a pair of transverse walls and a longitudinal bottom wall extended between the pair of longitudinal walls and the transverse walls, a receiving cavity surrounded by said pair of longitudinal and transverse walls, and a tongue board extending from the bottom wall of said receiving cavity; and wherein end portions of the contact portions resting against a top surface of the bottom wall.

4. The board-mounted electrical connector as claimed in claim 3, wherein the soldering portion essentially outwardly obliquely downwardly extends relative to the housing.

5. The board-mounted electrical connector as claimed in claim 4, wherein said soldering portion defines a flat upper surface extending parallel to the inner segment.

* * * * *